US010973723B2

(12) United States Patent
Li et al.

(10) Patent No.: US 10,973,723 B2
(45) Date of Patent: Apr. 13, 2021

(54) DENTAL TREATMENT MACHINE WITH A RETRACTABLE BACKREST FOR CHILDREN

(71) Applicant: GUANGZHOU AJAX MEDICAL EQUIPMENT CO. LTD., Guangzhou (CN)

(72) Inventors: Sheng Lin Li, Guangzhou (CN); Bing Lyu, Guangzhou (CN); Yuansheng Zhou, Guangzhou (CN); Xuehua Huang, Guangzhou (CN)

(73) Assignee: GUANGZHOU AJAX MEDICAL EQUIPMENT CO. LTD., Guangzhou (CN)

( * ) Notice: Subject to any disclaimer, the term of this patent is extended or adjusted under 35 U.S.C. 154(b) by 23 days.

(21) Appl. No.: 16/169,931

(22) Filed: Oct. 24, 2018

(65) Prior Publication Data

US 2019/0125604 A1 May 2, 2019

(30) Foreign Application Priority Data

Oct. 26, 2017 (CN) ..... 201711012725.2

(51) Int. Cl.

| | |
|---|---|
| ***A61G 15/10*** | (2006.01) |
| ***A61G 15/02*** | (2006.01) |
| *A61G 15/12* | (2006.01) |
| *A61G 15/14* | (2006.01) |
| *A61G 5/10* | (2006.01) |
| *A47C 1/024* | (2006.01) |

(52) U.S. Cl.

CPC ..... *A61G 15/105* (2013.01); *A61G 15/02* (2013.01); *A47C 1/024* (2013.01); *A47C 1/0248* (2013.01); *A61G 5/1067* (2013.01); *A61G 15/12* (2013.01); *A61G 15/14* (2013.01); *A61G 2200/14* (2013.01); *A61G 2203/70* (2013.01); *A61G 2210/00* (2013.01)

(58) Field of Classification Search

CPC ..... A61G 15/00–18; A61G 5/1067; A61G 5/122; B60N 2/66; A47C 1/024; A47C 1/0248; A47C 7/46; A47C 7/405; B61D 33/0021

USPC ..... 297/330, 284.3

See application file for complete search history.

(56) References Cited

U.S. PATENT DOCUMENTS 3,338,632 A * 8/1967 Kleinsorge ..... A61G 15/02 297/330
3,554,598 A * 1/1971 Dunkin ..... A61G 15/02 297/330
3,984,146 A * 10/1976 Krestel ..... A61G 15/02 297/330

(Continued)

*Primary Examiner* — Syed A Islam
(74) *Attorney, Agent, or Firm* — Masuvalley & Partners

(57) ABSTRACT

Embodiments of the present invention provide a dental treatment machine for children. The dental treatment machine may include a base, a cushion and a backrest, where the vertical distance between the base and the cushion, the angle between respective planes of the cushion and the backrest, as well as the horizontal distance between the cushion and the backrest are selectively adjustable according to a child's figure. Preferably, the vertical distance adjustment between the cushion and the base is about 350-730 mm, the angle adjustment between the backrest and the cushion is about 0°~68°, and the distance adjustment between the backrest and the cushion is about 0~50 mm.

19 Claims, 4 Drawing Sheets

(56) References Cited

U.S. PATENT DOCUMENTS 4,017,118 A * 4/1977 Cawley ..... A61G 15/02 297/284.3
4,047,758 A * 9/1977 Whitehill ..... A61G 15/02 297/284.1
4,860,733 A * 8/1989 Parker, Jr. ..... A61H 1/0292 601/24
5,190,349 A * 3/1993 Austin, Jr. ..... A61G 15/02 297/316
5,628,546 A * 5/1997 Boetzkes ..... A61G 15/02 297/316
5,790,997 A * 8/1998 Ruehl ..... A47C 17/162 297/316
6,530,622 B1 * 3/2003 Ekern ..... B60N 2/2222 297/284.1
6,916,065 B2 * 7/2005 Park ..... A61B 1/00048 297/135
7,287,376 B2 * 10/2007 Macht ..... F16D 23/12 60/533
7,686,394 B2 * 3/2010 Nishikawa ..... B60N 2/2222 297/284.1
7,708,344 B1 * 5/2010 Broering ..... A61G 15/02 297/330
7,914,076 B2 * 3/2011 Broering ..... A61G 15/02 297/310
8,025,336 B2 * 9/2011 Hanus ..... A61G 15/02 297/344.16
8,297,564 B2 * 10/2012 Jackson ..... A61G 15/02 248/157
8,939,500 B2 * 1/2015 Voigt ..... A47C 1/0242 297/173
9,220,348 B2 * 12/2015 Stieler ..... A47C 7/68
9,809,174 B1 * 11/2017 Torres ..... A47C 1/11
10,035,442 B2 * 7/2018 Kondrad ..... B60N 2/1615
2002/0182575 A1 * 12/2002 Vannoye ..... G06F 19/325 434/263
2003/0036033 A1 * 2/2003 Chandler ..... A61C 1/0061 433/77
2003/0057749 A1 * 3/2003 Buono ..... B60R 11/02 297/217.3
2004/0007907 A1 * 1/2004 DiRe ..... A61C 19/00 297/217.3
2004/0183352 A1 * 9/2004 Schron ..... A61C 1/0007 297/323
2010/0077918 A1 * 4/2010 Holzl ..... F15B 15/1428 92/169.2
2016/0242623 A1 * 8/2016 Pasini ..... A61B 90/36
2016/0346144 A1 * 12/2016 Scott ..... A61G 15/02
2017/0296416 A1 * 10/2017 Scott ..... A61G 13/0018
2018/0353364 A1 * 12/2018 Park ..... A61G 15/02
2018/0357384 A1 * 12/2018 St. Louis ..... A61C 19/00

* cited by examiner

DENTAL TREATMENT MACHINE WITH A RETRACTABLE BACKREST FOR CHILDREN

This application claims the priority benefit of CN Application No. 201711012725.2 filed on Oct. 26, 2017, which are hereby expressly incorporated by reference in their entirety for all purposes.

FIELD OF THE INVENTION

This invention relates generally to medical instruments and more particularly to a dental treatment machine with a retractable backrest for children.

BACKGROUND OF THE INVENTION

A dental treatment machine is a commonly used medical instrument in department of stomatology. The height, the backrest and the headrest of the prior art dental machines are often fixed, and therefore they cannot accommodate children comfortably because children cannot maintain their relaxed seated or lying posture on the prior art dental treatment machines. In addition, children are easy to move, which also may increase the difficulty of treatment.

SUMMARY OF THE INVENTION

The present invention is proposed in view of the above aforementioned problems. In order to overcome the problems of the prior art dental machines, the foregoing technical solutions are adopted in an embodiment of a dental treatment machine for children having a headrest, a retractable backrest, a cushion, and a base. The dental treatment machine further includes a multimedia structure and a seat adjustment means. The seat adjustment means according to the embodiments of the present invention may include a seat lifting part, a backrest rotating part and a backrest expansion part. The seat lifting part is disposed between the base and the cushion of the dental treatment machine for vertically adjusting the distance between the base and the cushion and thus selectively adjusting the height therebetween. On the other hand, the backrest rotating part and the backrest expansion part are disposed respectively between the cushion and the retractable backrest for rotating and telescoping the backrest with respect to the cushion.

In one embodiment, the seat lifting part may include an adjustment bracket, a lift motor and a gas spring, where the adjustment bracket is rotatably connected to the base on one end. The other end of the adjustment bracket has two sides, where the gas spring is rotatably connected between one side of the adjustment bracket and the base, and the lift motor is rotatably connected between the other side of the adjustment bracket and the base through a motor pin. An output shaft of the lift motor is sheathed with a plastic sleeve which is screwed to the output shaft while an upper end of the plastic sleeve is rotatably connected to the lower surface of the cushion.

In a preferred embodiment, the seat lifting part is configured to raise the cushion such that the distance between the cushion and the base is about 350-730 mm.

The backrest rotating part according to the embodiments of the present invention may include an angle adjustment motor, a transmission shaft and an aluminum bending plate. An upper end of the cushion which is in vicinity of the backrest is provided with the transmission shaft, where the cushion is rotatably connected with the aluminum bending plate through the transmission shaft and the angle adjustment motor is fixedly connected to one end of the transmission shaft. In the preferred embodiment, the angle adjustment between the respective plane of the retractable backseat and the cushion is about 0°~68°.

The backrest expansion part according to the embodiments of the present invention may include a telescopic adjustment motor, a push rod, a backboard, a slider, and a sliding rail. In this embodiment, the telescopic adjustment motor is fixedly mounted on the aluminum bending plate and is connected to the push rod, where the slider is fixed on an upper end of the push rod and is connected to the sliding rail in a sliding mode. The sliding rail is disposed on the aluminum bending plate so as to correspond to both sides of the slider. The backboard is fixed onto a front surface of the slider while the retractable backrest is being attached to a front surface of the backboard. In the preferred embodiment, the distance adjustment between the retractable backrest and the cushion is about 0~50 mm.

In yet another embodiment, a lumbar or waist pillow is disposed between the cushion and the retractable backrest so that the lumbar pillow is attached to a lower side of the aluminum bending plate while it can rotate with a rotation of the retractable backrest.

In the preferred embodiment, the seat adjustment means is covered with a protective shell.

In yet anther embodiment, the multimedia structure comprises a multimedia bracket, which is disposed at one end of the headrest. The multimedia bracket is configured to be movable in a horizontal direction and is located above the headrest. In this embodiment, a display screen and the associated control panel are mounted on the multimedia bracket. Additionally, a fixing clip for mounting a mobile device is mounted on the multimedia bracket.

In an alternative embodiment, the multimedia structure may include a multimedia bracket and a first rotating bracket. In this embodiment, the lower end of the first rotating bracket is rotatably connected to the base through a rotating shaft, and the multimedia bracket is fixedly mounted on said first rotating bracket.

In yet another embodiment, the dental treatment machine may include a vertical pillar on its base where a second rotating bracket is disposed on a side wall of this vertical pillar, and a tool placing rack is provided on the second rotating bracket. In addition, an upper end of the vertical pillar is rotatably connected with a third rotating bracket, which is being provided with an LED cold light at its other end.

In accordance with a second aspect of the present invention, there is provided a dental treatment machine for children having a base, a cushion and a backrest, where the vertical distance between the base and the cushion, the angle between respective planes of the cushion and the backrest, as well as the horizontal distance between the cushion and the backrest are selectively adjustable according to a child's figure. Preferably, the vertical distance adjustment between the cushion and the base is about 350-730 mm, the angle adjustment between the backrest and the cushion is about 0°~68°, and the distance adjustment between the backrest and the cushion is about 0~50 mm.

By way of comparison with prior art, embodiments of the present invention provide the following advantages and effects as a result of the application of the above solutions. The seat adjustment means according to the embodiments of the present invention enables the cushion to move downwards to reach a lower position. Accordingly, an ultra-low seat is more acceptable to children, especially the very young ones, and therefore it is convenient for children to sit on. The backrest can rotate and move telescopically under the action of two motors, and is adjustable according to the body size of the children to meet the required treatments for patients with different sizes, ensuring the comfort of the patient. When children are being treated on the dental treatment machine of the present invention, the multimedia bracket which has a display to play videos can rotate over the children's head, and can also be used with a tablet to relieve children's tension.

BRIEF DESCRIPTION OF THE DRAWING

The present disclosure is described in conjunction with the appended figures.

Figure 1:
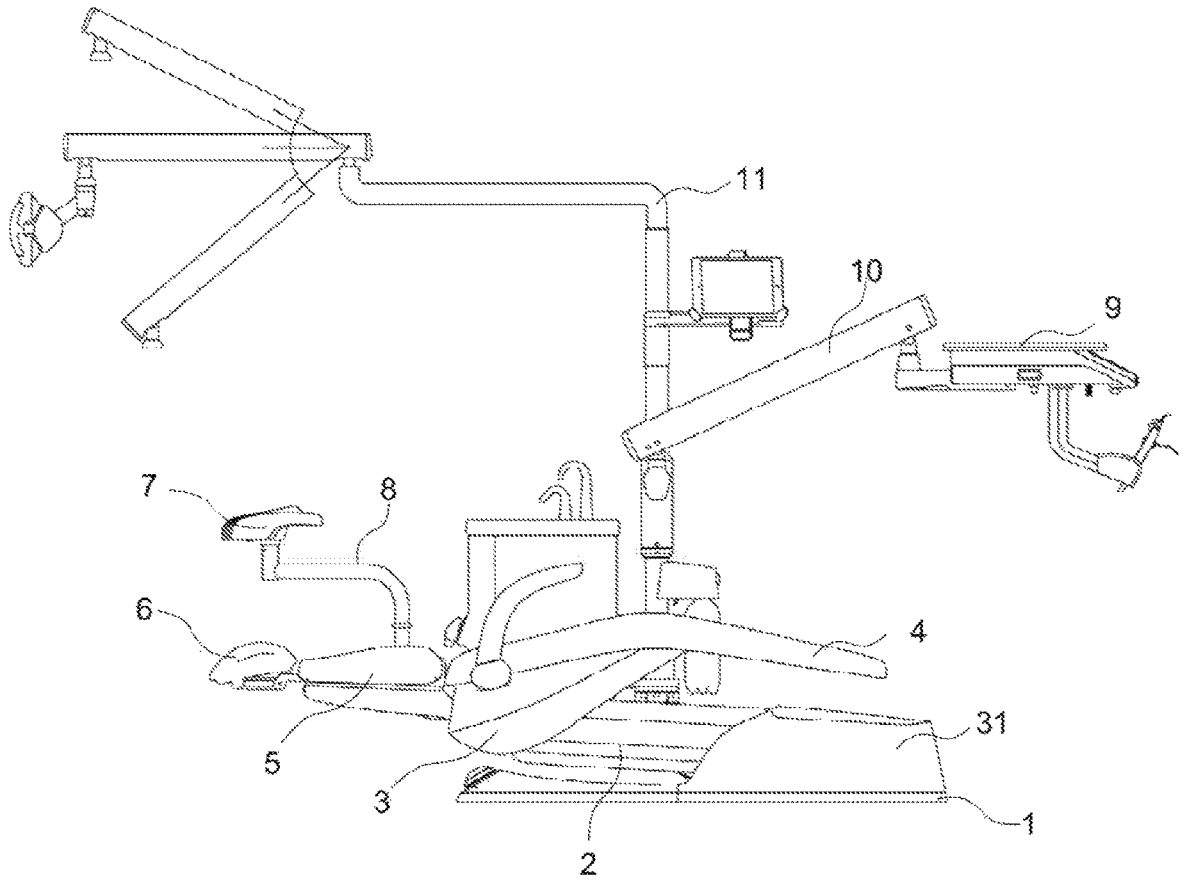
FIG. 1 depicts schematically a side view of an embodiment of a dental treatment machine with a retractable backrest for children.

In the appended figures, similar components and/or features may have the same reference numeral, wherein like reference numerals refer to like parts throughout the various views unless otherwise specified. For ease of understanding, the main components are listed below with their corresponding reference numerals: 1: base, 2: adjustment bracket, 3: protective shell, 4: cushion, 5: backrest, 6: headrest, 7: multimedia bracket, 8: first rotating bracket, 9: tool placing rack, 10: second rotating bracket, 11: third rotating bracket, 12: angle adjustment motor, 13: lift motor, 14: telescopic adjustment motor, 15: gas spring, 16: transmission shaft, 17: push rod, 18: backboard, 19: aluminum bending plate, 20: slider, 21: sliding rail, 22: upper shell of aluminum bending plate, 23: lumbar or waist pillow, 24: lower shell of aluminum bending plate, 25: backrest lifting control board, 26: rear lower shell of adjustment bracket, 27: foot pedal or foot switch, 28: rear bottom shell, 29: front upper shell of adjustment bracket, 30: electrical outlet box, 31: large front shell, 32: main seat-frame, 34: arm-rest: plastic sleeve, 40.

DETAILED DESCRIPTION OF THE INVENTION

Referring first to the FIG. 1, a side view of an embodiment of a dental treatment machine with a retractable backrest for children is shown. The dental treatment machine according to the embodiments of the present invention may include a base 1, a cushion 4, a protective shell 3, a retractable backrest 5 and a headrest 6. The dental treatment machine further includes a seat adjustment means and a multimedia structure which will be described in more detail further below. The seat adjustment means includes a seat lifting part which adjusts the vertical distance between the base 1 and the cushion 4. The seat adjustment mean further includes a backrest rotating part and a backrest expansion part for rotating and telescoping the backrest 5 with respect to cushion 4.

Figure 2:
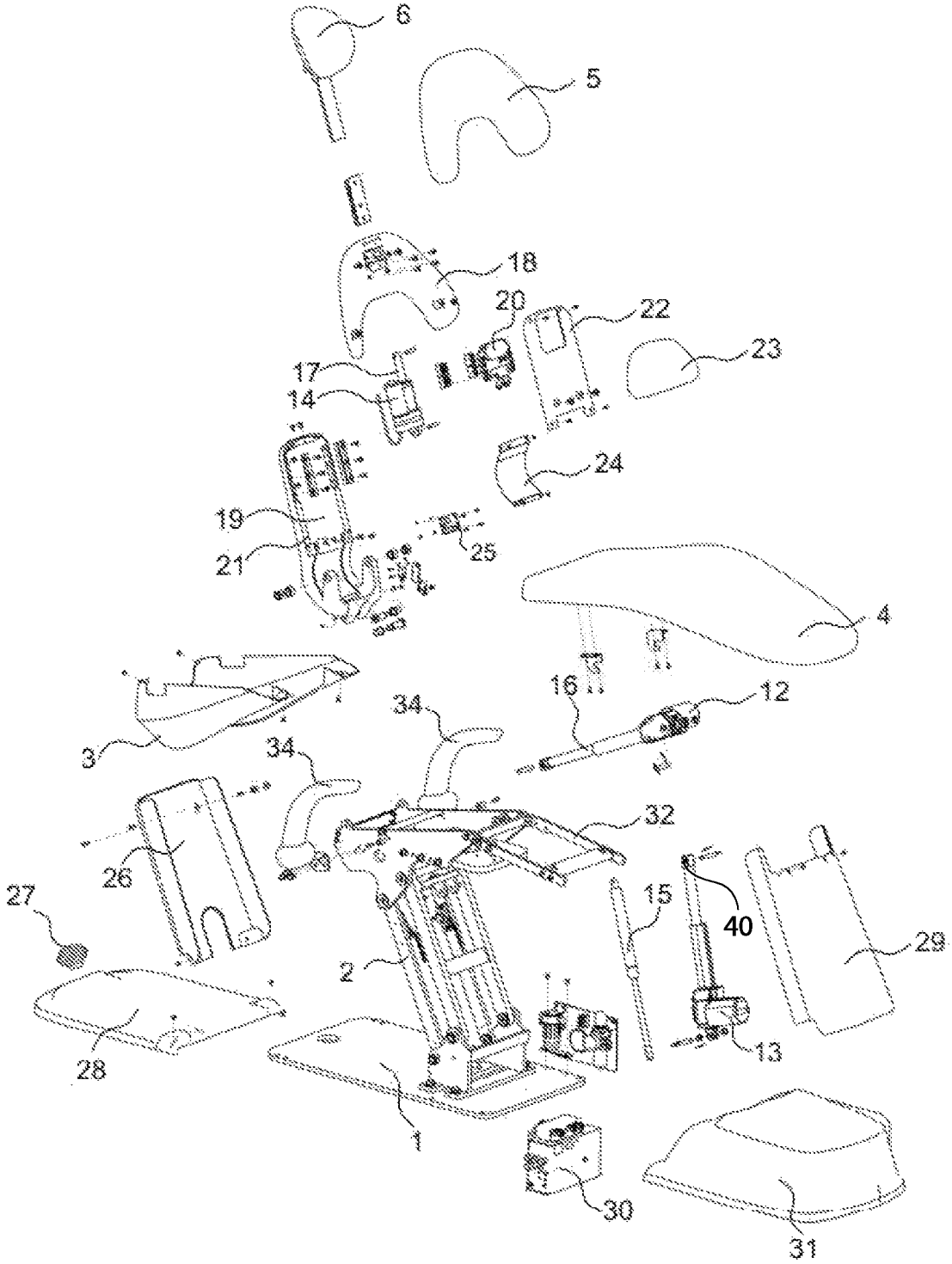
FIG. 2 depicts schematically an exploded view of an embodiment of a dental treatment machine with a retractable backrest for children.

The internal components of the seat adjustments means are best seen in FIG. 2 which illustrates an exploded view of the dental treatment machine with the retractable backrest for children. As shown in this exploded view, the seat adjustment means may include an adjustment bracket 2, an angle adjustment motor 12, a lift motor 13, a telescopic adjustment motor 14, a gas spring 15, a transmission shaft 16, a push rod 17, a backboard 18, an aluminum bending plate 19, a slider 20 and a sliding rail 21. Of the above components, the adjustment bracket 2, the lift motor 13 and the gas spring 15 constitute the seat lifting part of the present embodiment which is disposed between the base 1 and cushion 4.

As can be seen from FIG. 2, the adjustment bracket 2 which contains a parallel mechanism is rotatably and non-detachably connected to the base 1 on one end. On the other end of the adjustment bracket 2, a main seat-frame 32 is detachably mounted. In the preferred embodiment, the parallel mechanism of the adjustment bracket 2 and the main seat-frame 32 are made integrally so as to form a one-piece adjustment bracket 2 where two distinct arm-rests 34 are detachably mounted on the upper-end of the adjustment bracket 2. On the lower end of the adjustment bracket 2, which has two sides, the gas spring 15 is rotatably connected between one side of the adjustment bracket 2 and the base 1, and the lift motor 13 is rotatably connected between the other side of the adjustment bracket 2 and the base 1 through a motor pin. The lift motor 13 includes an output shaft which is sheathed via a plastic sleeve 40. The plastic sleeve 40 being screwed with the output shaft and an upper end of the plastic sleeve 40 is rotatably connected to a lower surface of the cushion 4. In this way, the vertical distance between the cushion 4 and the base 1 (height of cushion 4) can be selectively adjusted to desired positions by the connection of the lift motor 13 and the plastic sleeve 40. For the sake of visual appearance, a front upper shell 29 and a rear lower shell 26 are provided for covering the parallel mechanism section of the adjustment bracket 2. The seat lifting part of the seat adjustment means of the present invention is configured to raise the cushion 4 with respect to the base 1 such that the vertical distance therebetween is about 350-730 mm.

An electrical outlet box 30 selectively supports power and data communication wires therein. The electrical outlet box 30 can be reliably assembled on the base 1 in front of dental treatment machine and includes a plurality of access ports for providing separate selective entry of power and data/communication wires into the box. A rear bottom shell 28 and a large front shell 31 are mounted on the base 1 for the sake of protection and visual appearances. Additionally, a foot pedal or foot switch 27 may be selectively set the seat lifting part for adjusting the vertical distance between the cushion 4 and the base 1 by movement of the foot pedal 27, which is mounted onto the rear bottom shell 28, best seen in FIG. 1.

The backrest rotating part of the seat adjustment means according to the embodiments of the present invention may include the angle adjustment motor 12, the transmission shaft 16 and the aluminum bending plate 19. As can be seen from FIG. 2, an upper end of the cushion 4, which is located in vicinity of the retractable backrest 5, is provided with the transmission shaft 16. The cushion 4 is then rotatably connected with the aluminum bending plate 19 through the transmission shaft 16 and the angle adjustment motor 12 is fixedly connected to one end of the transmission shaft 16. In this way, the backrest rotating part is configured to adjust the angle between the retractable backrest 5 and the cushion 4 such that the angle between their respective planes is about 0°~68°.

Figure 3:
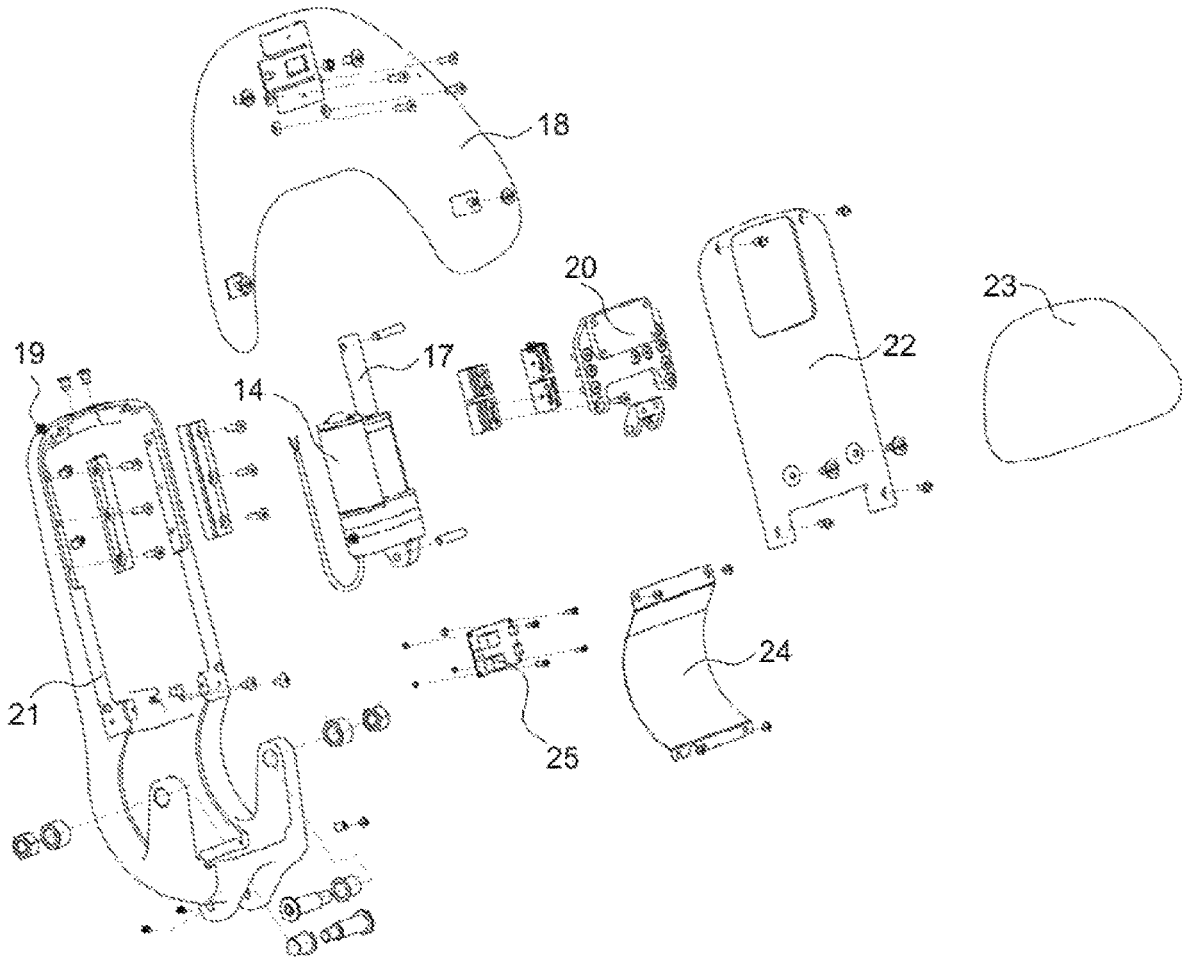
FIG. 3 illustrates an enlarged portion of FIG. 2, describing in greater clarity the backrest expansion part of the seat adjustment means.

FIG. 3, which is an enlarged portion of FIG. 2, illustrates in greater detail the backrest expansion part of the seat adjustment means according to the embodiments of the present invention. As can be seen from this figure, the backrest expansion part of the seat adjustment means may include the telescopic adjustment motor 14, the push rod 17 and the backboard 18, the slider 20 and the slider rail 21. The telescopic adjustment motor 14 may be fixedly mounted on the aluminum bending plate 19 while being connected to the push rod 17. The slider 20, which has two sides, may be attached to an upper end of the push rod 17 while being connected to the sliding rail 21 in a sliding mode. The sliding rail 21 is disposed on the aluminum bending plate 19 so as to correspond to both sides of the slider 20. In this embodiment, the telescopic adjustment motor 14 drives the push rod 17 to push the slider 20 to move up and down. Further, an upper shell 22 which includes a mating window or aperture is configured to fit over the telescopic adjustment motor 14 while exposing an outer surface of the slider 20. The upper shell 22 may be assembled with the sliding rail 21 covering an upper portion of the aluminum bending plate 21.

On the other hand, the backboard 18 may be attached onto the outer surface of the slider 20 so that it can move up and down by following the slider 20's movement. After installation of the backboard 18, the backrest 5, which is provided with a sponge that comes in contact with the human body, is attached onto an outer surface of the backboard 18 (as shown in FIG. 2). Additionally, a backrest lifting control board 25 may be assembled onto the sliding rail 21, for controlling the movement of the retractable backrest 5. In this way, the distance between the backrest 5 and the cushion 4 can be selectively adjusted through the internal structure of the dental treatment machine according to the child's figure and height.

According to a further preferred embodiment, a lumbar or waist pillow 23 may also be disposed between the cushion 4 and the retractable backrest 5 to provide support for children's lumbar section of the back. As can be seen from FIG. 3, the lower portion of the aluminum bending plate 19, which has substantially an arch-shaped, can be covered by a lower shell 24. The lumbar or waist pillow 23 cooperates in shape with the lower circumferential border of the backboard 18 or the retractable backrest 5 and with the lower portion of the aluminum bending plate 19 or the lower shell 24. The lumbar pillow 23 can be attached onto the lower shell 24 and can rotate with a rotation of the retractable backrest 5. In preferred embodiments, the backrest expansion part is configured to adjust the distance between the backrest 5 and the cushion 4 such that this distance can is about 0~68 mm.

In a more preferred embodiment, an outer portion of the seat adjustment means, which can be seen from the sides of the dental treatment machine, is covered by a protective shell 3 (FIGS. 1 & 2) to protect the internal structure, and also to prevent the children from contacting with the internal machinery for safe use of the seat. When in use, the seat adjustment means enables the cushion 4 to move downwards so as to reach a lower position which is more convenient for children to sit on. It should be noted that an ultra-low position is more acceptable to children, especially the very young ones. The backrest 6, according to the embodiments of the present invention, is rotating and telescoping under the action of their respective motors, and is adjustable according to the children's body size to meet the required treatment for patients with different sizes, ensuring the comfort of the patient.

Figure 4:
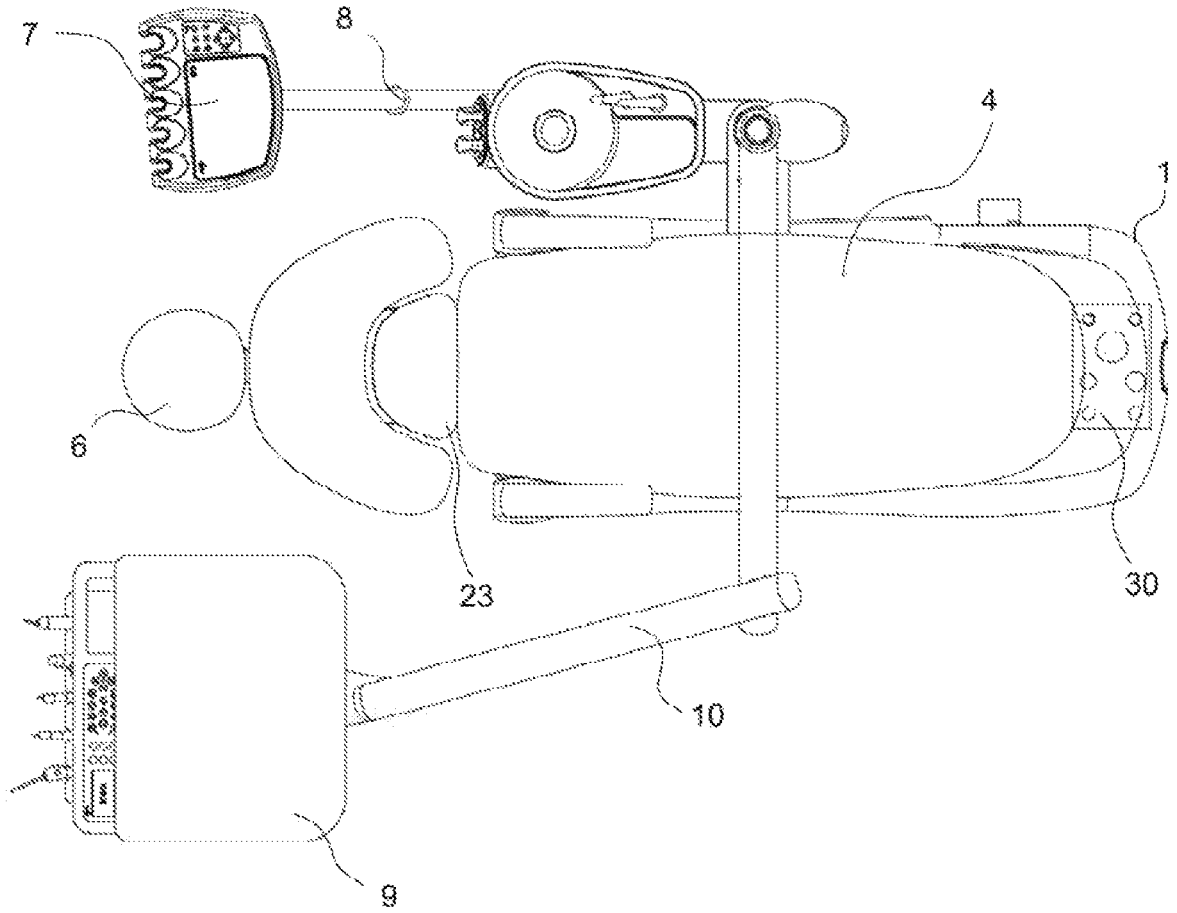
FIG. 4 depicts schematically an overhead view of an embodiment of a dental treatment machine with a retractable backrest for children.

With reference to FIG. 4, an overhead view of the dental treatment machine with the retractable backrest for children is shown. As can be seen from this figure, the multimedia structure, according to the embodiments of the present invention, may include a multimedia bracket 7 and a first rotating bracket 8. A lower end of the first rotating bracket 8 is rotatably connected to the base 1 through a rotating shaft. The multimedia bracket 7 is fixedly mounted on the first rotating bracket 8.

In an alternative embodiment, the multimedia structure may only include the multimedia bracket 7 (not shown) which is disposed at one end of the headrest 6 and is movable in a horizontal direction above the headrest 6. In the preferred embodiment, a display screen and its associated control panel are mounted on the multimedia bracket 7. Additionally, a fixing clip for fixing a mobile device such as, for example, a mobile phone or a tablet lamp is also fixedly mounted on the multimedia bracket 7. This allows for relieving children's tension by playing video games or movies using the multimedia devices. In this way, when children are treated on the dental treatment machine, the multimedia bracket 7 having the display for playing videos can rotate over the children's head and can also be used with a tablet for more convenience.

Referring back to FIG. 1, a vertical pillar is further disposed on the base 1 where a second rotating bracket 10 is disposed on a side wall of the vertical pillar. In addition, a tool placing rack 9 is disposed on the second rotating bracket 10 so that the tool placing rack 9 can be moved in different directions by the second rotating bracket 10 for use by the medical staff. As can be seen from FIG. 1, an upper end of the vertical pillar is rotatably connected with a third rotating bracket 11 and the other end of the third rotating bracket 11 is provided with an LED cold light to provide adequate lighting for medical staff to observe the oral cavity.

In addition, it should be understood that, although the specification is described according to the embodiments of the present invention, not each embodiment includes only one independent technical solution, this description of the specification is only for the sake of clarity and those skilled in the art should consider the specification as a whole, and the technical solutions in the embodiments can also be combined appropriately to form other embodiments that can be understood by those skilled in the art.

What is claimed is:

1. A dental treatment machine for children comprising a headrest; a retractable backrest; a cushion; a base; a multimedia structure; and a seat adjustment means, said seat adjustment means comprises a seat lifting part, a backrest rotating part, and a backrest expansion part, wherein the seat lifting part is disposed between the base and the cushion for vertically adjusting the distance between the base and the cushion and thus selectively adjusting the height therebetween, and wherein the backrest rotating part and the backrest expansion part are disposed respectively between the cushion and the retractable backrest for rotating and telescoping the backrest with respect to the cushion;

wherein the backrest expansion part comprises a backboard that is provided with a C-shaped opening which is downwardly opened, the C-shaped opening is arranged above a waist pillow which is disposed between the cushion and the retractable backrest, and the main body of the waist pillow can be detachably retracted into the C-shaped opening of the backboard.

2. The dental treatment machine according to claim 1, wherein the seat lifting part comprises an adjustment bracket; a lift motor; and a gas spring, wherein:

the adjustment bracket is adapted to be rotatably connected to the base at one end, the gas spring is adapted to be rotatably connected between one side of the other end of the adjustment bracket and the base, and on the other side of the other end of said adjustment bracket, the lift motor is adapted to be rotatably connected to the base through a motor pin.

3. The dental treatment machine according to claim 2, wherein a plastic sleeve is sheathed on an output shaft of the lift motor, said plastic sleeve being screwed with said output shaft, and an upper end of the plastic sleeve is rotatably connected to a lower surface of the cushion.

4. The dental treatment machine according to claim 1, wherein the seat lifting part is configured to raise the cushion such that the distance between the cushion and the base is about 350-730 mm.

5. The dental treatment machine according to claim 1, wherein the backrest rotating part comprises an angle adjustment motor; a transmission shaft; and an aluminum bending plate, wherein:

an upper end of the cushion is provided with said transmission shaft, the cushion is rotatably connected to the aluminum bending plate through said transmission shaft, and the angle adjustment motor is fixedly connected to one end of said transmission shaft.

6. The dental treatment machine according to claim 1, wherein the backrest rotating part is configured to adjust an angle between the retractable backrest and the cushion such that the angle between their respective planes is about 0° 68°.

7. The dental treatment machine according to claim 5, wherein the backrest expansion part comprises a telescopic adjustment motor; a push rod; a slider; and a sliding rail, wherein:

the telescopic adjustment motor is adapted to be fixedly mounted on the aluminum bending plate while being connected to the push rod, the slider is fixed on an upper end of the push rod and is connected to the sliding rail in a sliding mode, the sliding rail is disposed on the aluminum bending plate so as to correspond to both sides of the slider, the backboard is fixed onto a front surface of the slider while the retractable backrest is being attached to a front surface of said backboard.

8. The dental treatment machine according to claim 1, wherein the backrest expansion part is configured to adjust the distance between the retractable backrest and the cushion such that said distance is about 0~50 mm.

9. The dental treatment machine according to claim 5, wherein said waist pillow being attached to a lower side of the aluminum bending plate.

10. The dental treatment machine according to claim 9, wherein the waist pillow can rotate with a rotation of the retractable backrest.

11. The dental treatment machine according to claim 1, wherein an outer side of the seat adjustment means is covered by a protective shell.

12. The dental treatment machine according to claim 1, wherein the multimedia structure comprises a multimedia bracket disposed at one end of the headrest, said multimedia bracket is configured to be movable in a horizontal direction and is located above the headrest.

13. The dental treatment machine according to claim 12, wherein a display screen and an associated control panel are mounted on the multimedia bracket.

14. The dental treatment machine according to claim 1, wherein the multimedia structure comprises a multimedia bracket and a first rotating bracket, a lower end of said first rotating bracket is rotatably connected to the base through a rotating shaft, and the multimedia bracket is fixedly mounted on said first rotating bracket.

15. The dental treatment machine according to claim 14 further comprising a vertical pillar disposed on the base, wherein a second rotating bracket is disposed on a side wall of the vertical pillar.

16. The dental treatment machine according to claim 15 further comprising a tool placing rack disposed on the second rotating bracket.

17. The dental treatment machine according to claim 15, wherein an upper end of the vertical pillar is rotatably connected with a third rotating bracket.

18. The dental treatment machine according to claim 17, wherein one end of the third rotating bracket is provided with an LED cold light.

19. A dental treatment machine for children, comprising a base; a cushion; a backrest and a seat adjustment means, said seat adjustment means comprises a seat lifting part, a backrest rotating part, and a backrest expansion part, wherein:

a vertical distance between the base and the cushion, an angle between respective planes of the cushion and the backrest, and a horizontal distance between the cushion and the backrest are selectively adjustable according to a child's figure, the vertical distance between the cushion and the base is 350-730 mm, the angle between the backrest and the cushion is 0° ~68°, and the distance between the backrest and the cushion is 0~50 mm;

wherein the backrest expansion part comprises a backboard that is provided with a C-shaped opening which is downwardly opened, the C-shaped opening is arranged above a waist pillow which is disposed between the cushion and the retractable backrest, and the main body of the waist pillow can be detachably retracted into the C-shaped opening of the backboard.

* * * * *